US007175403B2

(12) United States Patent
Portolese et al.

(10) Patent No.: US 7,175,403 B2
(45) Date of Patent: Feb. 13, 2007

(54) INTEGRATED SELECT HIGH PRESSURE VALVE

(75) Inventors: Larry A. Portolese, Granger, IN (US); Gerry E. Fluga, Bremen, IN (US); William Scott Rowan, South Bend, IN (US)

(73) Assignee: Honeywell International Inc., Morris Township, NJ (US)

( * ) Notice: Subject to any disclaimer, the term of this patent is extended or adjusted under 35 U.S.C. 154(b) by 268 days.

(21) Appl. No.: 10/920,885

(22) Filed: Aug. 18, 2004

(65) Prior Publication Data

US 2006/0285988 A1 Dec. 21, 2006

Related U.S. Application Data

(60) Provisional application No. 60/511,637, filed on Oct. 17, 2003.

(51) Int. Cl.
*F01C 21/00* (2006.01)

(52) U.S. Cl. ..... 418/82; 418/268; 92/121

(58) Field of Classification Search ..... 92/120, 92/121, 124, 125; 418/268
See application file for complete search history.

(56) References Cited

U.S. PATENT DOCUMENTS 2,798,462 A 7/1957 Ludwig et al.
2,966,144 A * 12/1960 Self ..... 92/122
3,053,236 A 9/1962 Self et al.
3,066,654 A * 12/1962 Matt ..... 92/125
3,195,421 A 7/1965 Rumsey et al.
5,807,072 A * 9/1998 Payling ..... 415/170.1
6,237,466 B1 5/2001 Fukuhara et al.

FOREIGN PATENT DOCUMENTS

GB 2 229 778 A 10/1990

* cited by examiner

*Primary Examiner*—Hoang Nguyen
(74) *Attorney, Agent, or Firm*—Birch, Stewart, Kolasch & Birch, LLP.

(57) ABSTRACT

A rotary actuator includes one or more rotor vanes (40); an endplate (60); a corner seal (30) being positioned between the rotor vanes (40) and the endplate (60); a vane seal (20); a high pressure chamber and a low pressure chamber; and a single channel (22) extending from a lower portion of a vane seal groove (25) to a common channel (28) beneath the vane seal (20), wherein the high pressure chamber is in fluid communication with the corner seal (30) via the single channel (22) and the common channel (28). The common channel (28) may be formed in the rotor vane (40) or provided separately in a rotor vane flow sleeve (21) positioned along an interior surface of the rotor vane (40). The single channel (22) is machined from the bottom of the vane seal groove (25) to the area behind the corner seal (30). A second set of endplates (60), corner seal (30), single channel (26) and common channel (29) may be provided at an axially opposite end of the rotor vane (40) from the first set channels in each rotor vane (40).

10 Claims, 4 Drawing Sheets

INTEGRATED SELECT HIGH PRESSURE VALVE

CROSS-REFERENCE TO RELATED APPLICATIONS

This nonprovisional application claims priority under 35 U.S.C. §119 on U.S. Provisional Patent No. 60/511,637, entitled "INTEGRATED SELECT HIGH PRESSURE VALVE" and filed on Oct. 17, 2003, the entirety of which is hereby incorporated by reference.

STATEMENT REGARDING FEDERALLY SPONSORED RESEARCH

The present invention was made with Government support under Contract No. N00019-02-C-3003 awarded by the United States Navy. The Government has certain rights in this invention.

TECHNICAL FIELD AND INDUSTRIAL APPLICABILITY OF THE INVENTION

The present invention is generally directed to the field of rotary vane actuators, and more particularly to vane sealing for rotary vane actuators.

DESCRIPTION OF THE BACKGROUND ART

U.S. Pat. No. 2,798,462 (Ludwig et al.); U.S. Pat. No. 3,053,236 (Self et al.); U.S. Pat. No. 3,155,013 (Rumsey); U.S. Pat. No. 3,195,421 (Rumsey et al.); U.S. Pat. No. 3,232,185 (Kummerman); and U.S. Pat. No. 3,583,838 (Stauber), the entirety of each of which are hereby incorporated by reference, describe a variety of control devices, actuators and sealing systems for a range of fluid motors and/or pumps.

Self et al. describe an oscillatory actuator seal system for an actuator assembly of the background art. As seen in FIGS. 1–3 of Self et al., a rotor shaft (element 8) having a pair of diametrically opposed rotor vanes (elements 9 and 10) is provided centrally between a pair of branch rotor shaft vane chambers within a generally rectangularly shaped actuator housing (element 6). The rotor vanes (element 9 and 10) separate the pair of fluid chambers into opposed compartments, i.e., a first vane (element 9) divides a first chamber into a first pair of compartments (elements 11 and 12) and a second vane (element 10) divides a second chamber into a second pair of compartments (elements 13 and 14).

In Self et al., a pressurized control fluid is admitted into the first pair of compartments (elements 11 and 12) through control passages and into the second pair of compartments (elements 13 and 14) through passages (elements 30, 31) extending through the center of the rotor. By varying the pressure conditions in the control passages to create a pressure differential across the first set of vane compartments (elements 11 and 12), the vane (element 9) will be moved toward the region of low pressure. As a result of the movement of the vanes (elements 9 and 10), the rotor shaft (element 8) will oscillate through a controlled and finite angular range that permits the rotor shaft to be connected to a control member, e.g., such as a flight control device. Accordingly, the vaned rotor shaft (elements 9 and 10) serves as a servoactuator for controlling a member through an angular range. Seal members (elements 32 and 33) are provided operatively engaging grooves on opposed sides of the rotor and the surrounding housing (element 6) in order to prevent leakage of control fluid from a high pressure compartment to a low pressure compartment. In addition, the leading edge of each vane (elements 9 and 10) is provided with a seal (elements 36 and 37, respectively) engaging the surrounding housing (element 6) and positioned within a groove formed on the leading edge of the vanes (elements 9 and 10).

The present invention is directed at overcoming shortcomings identified by the present inventors with rotary vane actuators of the aforementioned type, i.e., including actuators having one or more rotor vanes and forming two or more pressurized compartments.

SUMMARY OF THE PRESENT INVENTION

The present invention overcomes several shortcomings associated with the background art and achieves other advantages not realized by the background art. The present invention is intended to alleviate one or more of the following problems and shortcomings of the background art specifically identified by the inventors with respect to the background art.

The present invention, in part, is a recognition that it will be advantageous to utilize high pressure within a rotary actuator to energize a corner seal between the rotor vanes and an end plate of a rotary actuator. The seal blocks the leak path from high pressure on one side of the rotary vanes to lower pressure on the opposite sides thereof.

The present invention, in part, is a recognition that the above-described seal can be maintained in a sealing contact with a moving vane if the pressure from a chamber with the higher pressure is selectively channeled behind the seal.

The present invention, in part, is a recognition that a seal accomplishing one or more of the above-described features should be relatively easy to machine in order to reduce production time while reducing costs.

The present invention, in part, provides a rotary actuator comprising an actuator housing; at least one rotor vane operatively engaged with a rotatable actuator shaft within the actuator housing; an endplate being secured at a first end of the housing and in relative operative contact with the at least one rotor vane; a corner seal being positioned between the at least one rotor vane and the endplate for operatively sealing a space formed between the at least one rotor vane and the endplate; a vane seal being positioned between the at least one vane and the corner seal; a high pressure chamber; and a single channel extending from a lower portion of the vane seal to a common channel beneath the vane, wherein the high pressure chamber is in fluid communication with the corner seal via the single channel and the common channel.

The present invention, in part, provides a rotary actuator comprising at least one rotor vane engaged with a rotor shaft and positioned within a housing; at least one first endplate enclosing a first end of the at least one rotor vane within the housing; at least one second endplate enclosing a second end of the at least one rotor vane within the housing; a first corner seal and a second corner seal being operatively positioned between each of the first and second ends of the at least one rotor vane and the first and second endplates; at least one high pressure chamber and at least one low pressure chamber formed on opposite sides of the at least one rotor vane; and a vane seal operatively movable within a vane seal groove formed along a periphery of the at least one rotor vane, the vane seal being movable between a first sealing position and a second sealing position, wherein the first sealing position operatively and selectively isolates the at least one high pressure chamber from the at least one low pressure chamber and energizes the corner seal with fluid from the at least one high pressure chamber in a sealing engagement with the at least one endplate.

BRIEF DESCRIPTION OF THE DRAWINGS

The present invention will become more fully understood from the detailed description given hereinafter and the accompanying drawings that are given by way of illustration only, and thus do not limit the present invention.

DETAILED DESCRIPTION OF THE PREFERRED EMBODIMENTS

Figure 1:
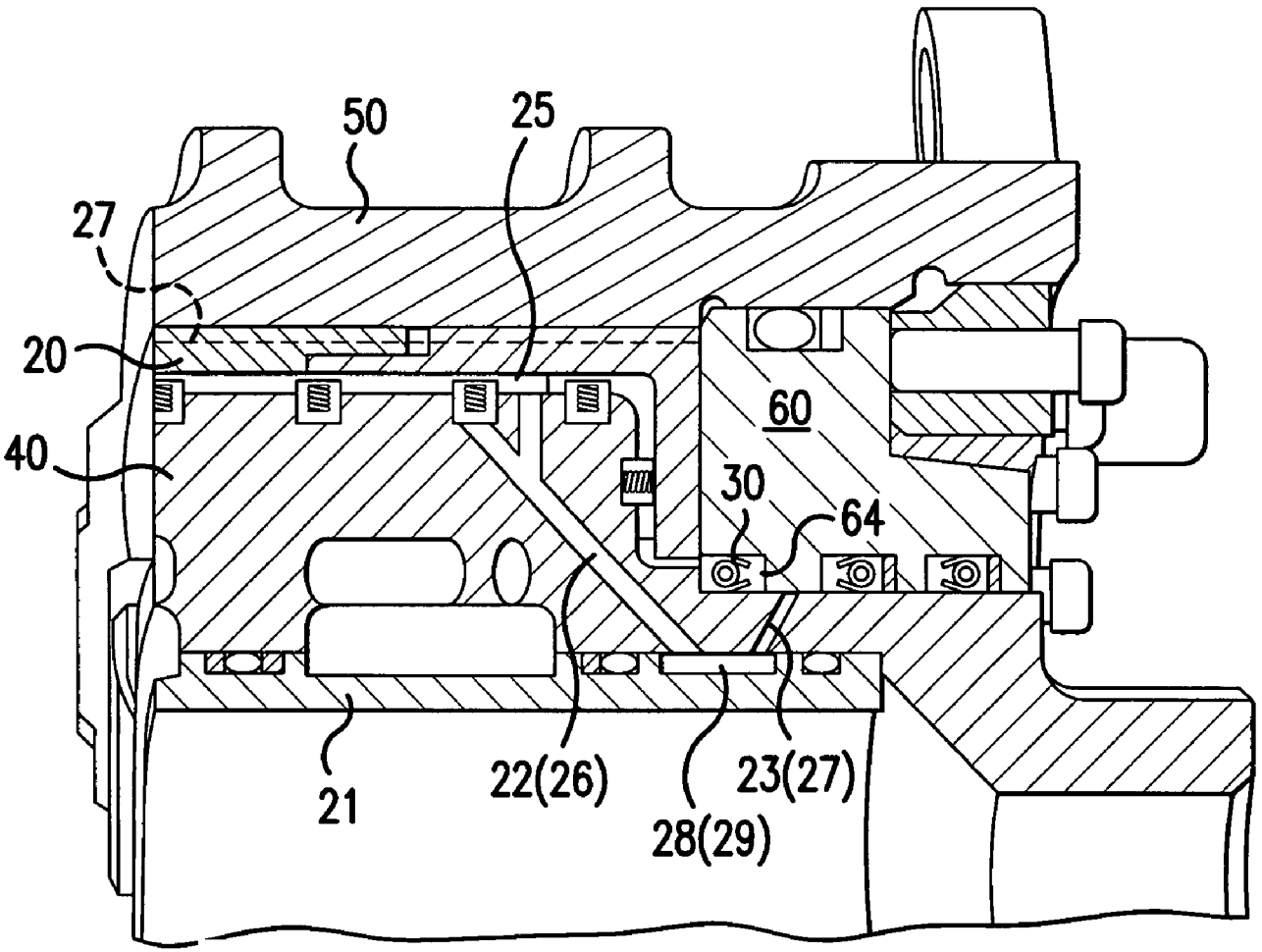
FIG. 1 is partial, sectional view of a rotary vane actuator according to an embodiment of the present invention.
Figure 2:
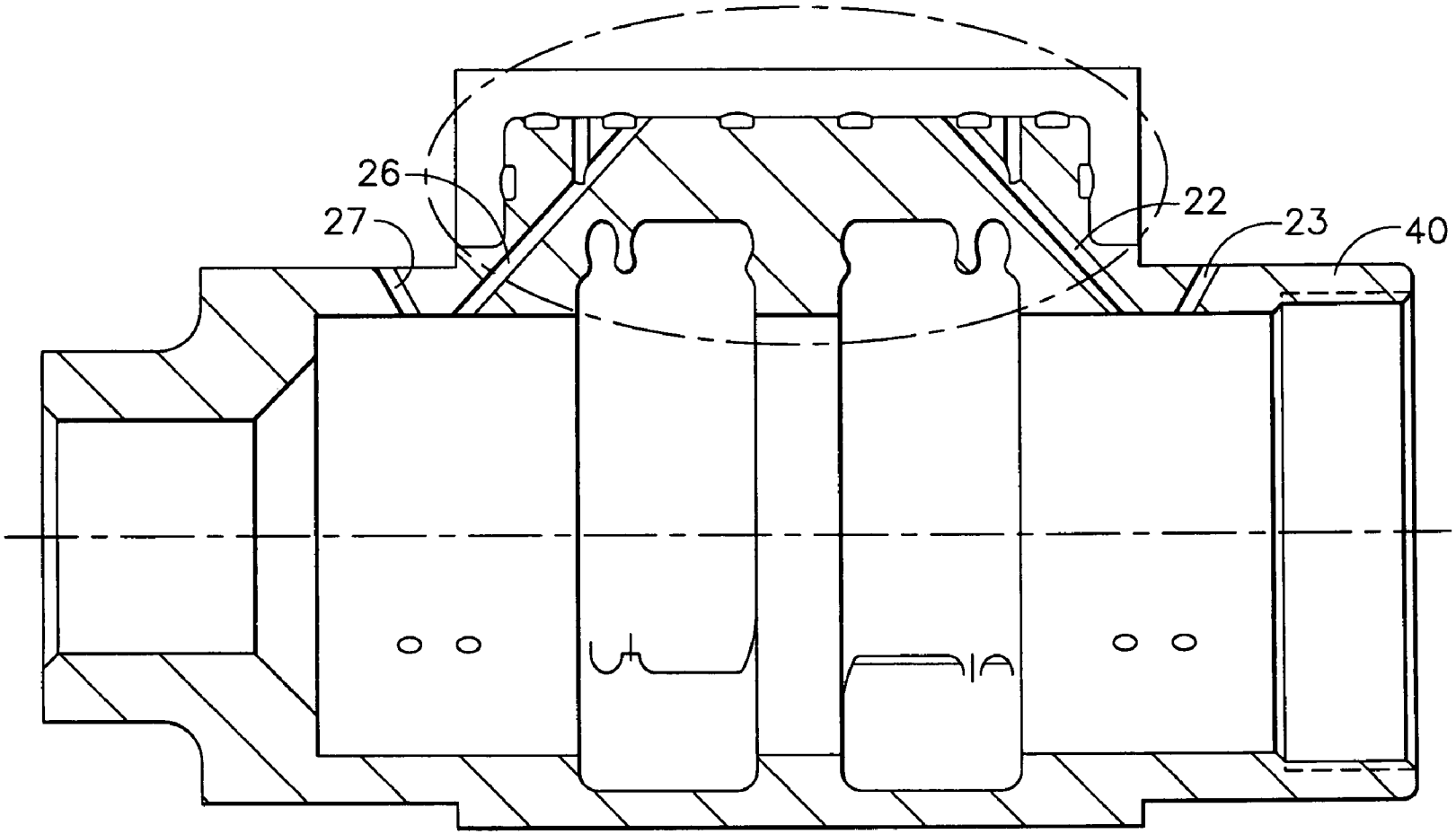
FIG. 2 is a side, sectional view of a vane seal for a rotary vane actuator according to an embodiment of the present invention.
Figure 3:
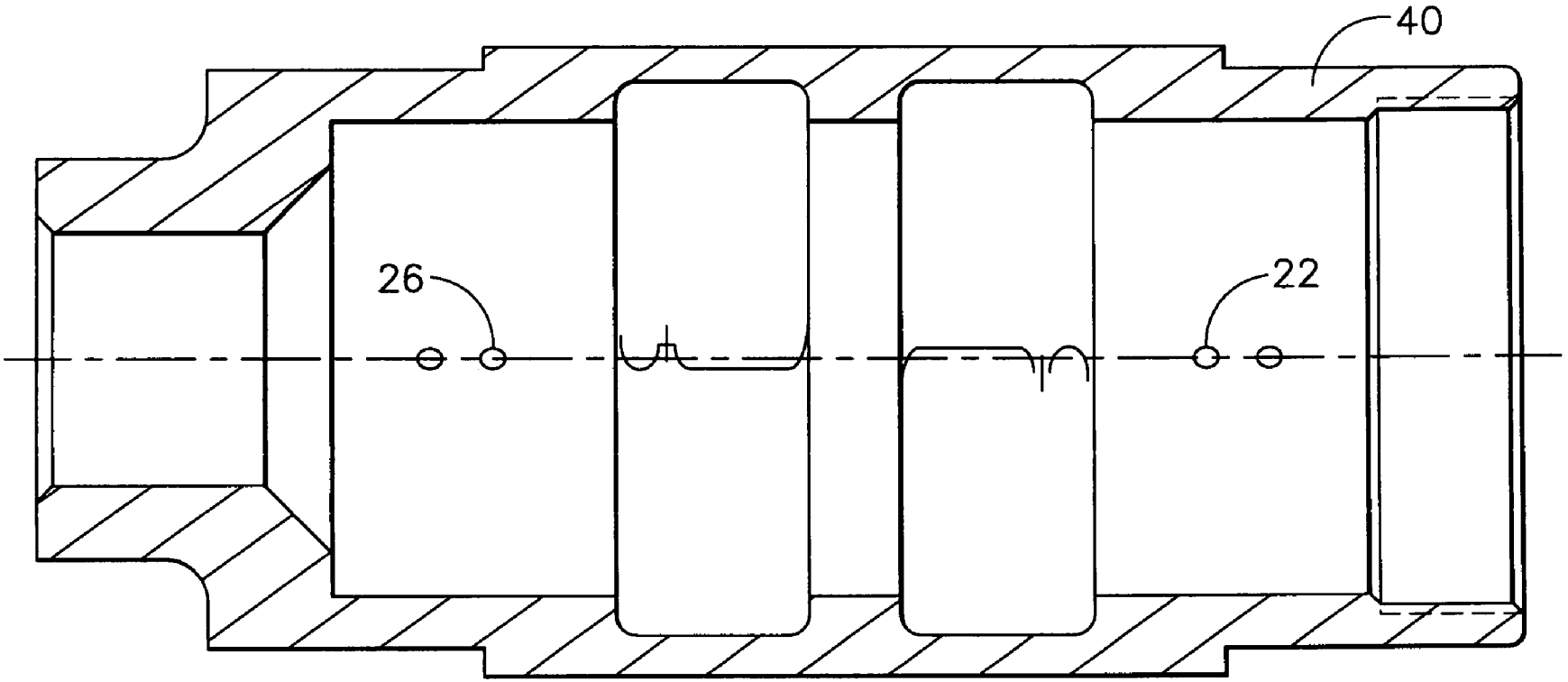
FIG. 3 is a partial sectional view taken along the axial centerline of the vane seal shown in FIG. 2.
Figure 4:
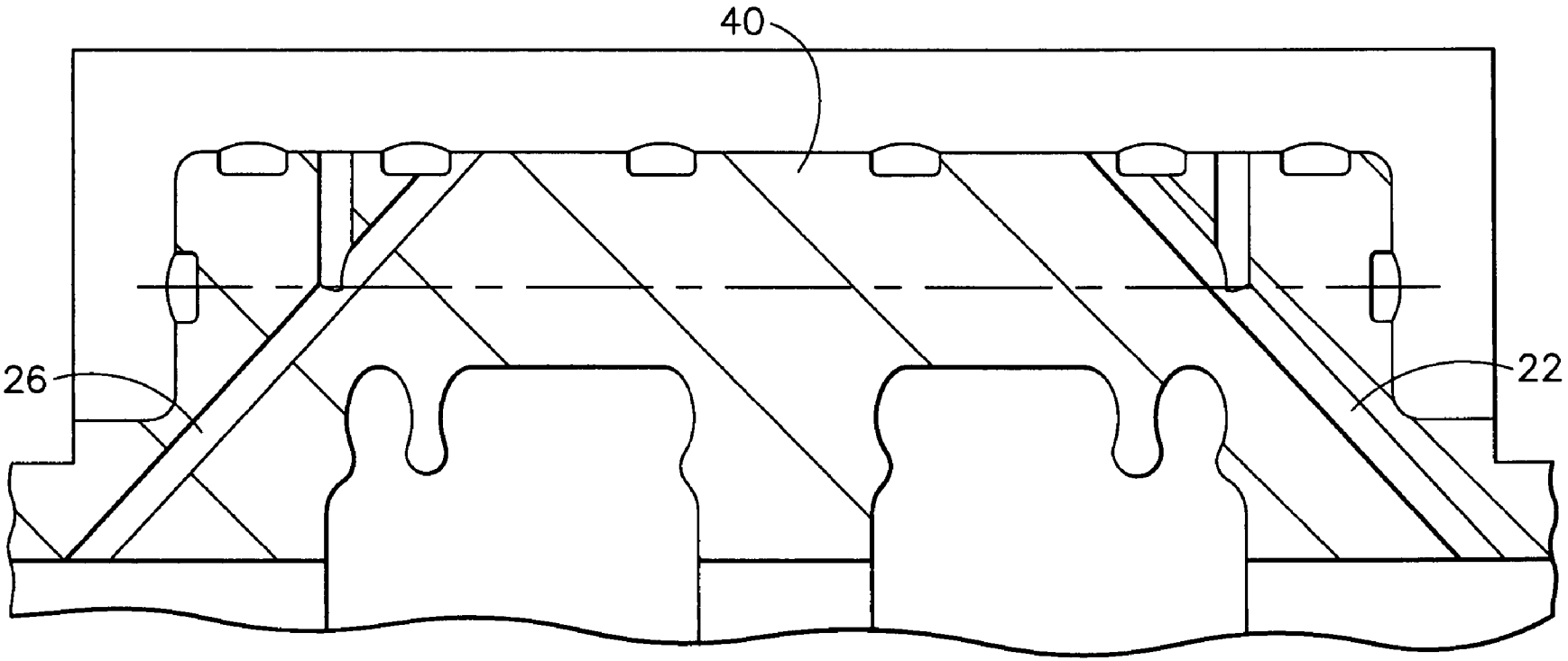
FIG. 4 is an enlarged, partial sectional view of the upper portion of the vane seal shown in FIG. 2.

The present invention will now be described in detail with reference to the accompanying drawings. FIG. 1 is partial sectional view of a rotary vane actuator according to an embodiment of the present invention. FIG. 2 is a side, sectional view of a vane seal for a rotary vane actuator according to an embodiment of the present invention. FIG. 3 is a partial sectional view taken along the axial centerline of the vane seal shown in FIG. 2. FIG. 4 is an enlarged, partial sectional view of the upper portion of the vane seal shown in FIG. 2.

The inventors of the present invention have determined that there are numerous shortcomings with the methods and apparatus of the background art relating to the aforementioned control devices, actuators and sealing systems. As described in greater detail hereinabove, U.S. Pat. No. 3,053,236 (Self et al.) describes vane seals but does not select the highest pressure available in any chamber (elements 11–14 of Self et al.) to energize a seal area or for any other purpose.

U.S. Pat. No. 2,798,462 (Ludgwig et al.) describes a vane motor design that does not define any select high pressure feature or similar porting that would direct the highest pressure in any chamber to a seal area or provide the high pressure for any other purpose during the operation of the device. U.S. Pat. No. 3,155,013 (Rumsey) describes a technique to relieve high pressures resulting from a surge to a low pressure chamber, but does not suggest using the pressure under the seal as a select high pressure feature. Similarly, U.S. Pat. No. 3,195,421 (Rumsey et al.) describes the sealing of vane corners, but does not suggest any pressure selection channels or the use of selected high pressure regions to energize the seals. U.S. Pat. No. 3,232,185 to Kummerman describes a vane sealing system, but does not use selected high pressure for the energization of a seal or the pressure beneath a seal as a pressure source. U.S. Pat. No. 3,583,838 (Stauber) appears to describe a method of seal energization and sealing. However, the energization of the seal(s) of Stauber is from an external source and/or does not utilize a high pressure source or sources.

As seen in FIG. 1, a rotary actuator of the present invention is shown having a rotor 40 having a vane seal groove 25 with an outer edge 27 on a first end thereof. A vane seal 20 is operatively fitted in groove 25 and retained in the groove by the groove itself and the wall of a surrounding housing 50 which limits the radial movement of the vane seal away from rotor 40. Rotor 40 and vane seal 20 move within a space defined in part by housing 50 and end plate 60, and end plate 60 includes a recess 64 in which a corner spring seal 30 is mounted. The present inventors have determined that rotary actuators may utilize high pressure to energize a corner seal 30 region extending between a corner edge of respective rotor vanes 40 and the end plate 60. The corner seal, e.g., a spring seal 30 in the preferred embodiment shown in FIG. 1, blocks a potential leak path from high pressure on one side of the vane 40 to a lower pressure region on the opposite side, e.g., similar to a pressure differential occurring between the first pair of compartments (elements 11 and 12) surrounding the first vane (element 9) of the Self et al. reference described hereinabove. However, in the present invention, the corner seal 30 is maintained in contact with the moving vane 40 by selective high pressure, e.g., high pressure from a relatively high pressure chamber that is channeled behind the seal.

In unidirectional actuators, the load on the actuator is predominately unidirectional so that the same chamber is always higher than the opposite and dedicated low pressure chamber. Accordingly, a simple channel is drilled from a high pressure source operatively connected to the high pressure chamber to the area behind the corner seal 30. However, the present inventors have determined that if the load reverses in an actuator that is not unidirectional, e.g., there are no dedicated high and low pressure chambers, the load on the actuator reverses which causes the high pressure chamber to switch or alternate between the two chambers. Accordingly, the present inventors have determined how to selectively apply high pressure in a rotary vane actuator to a corner seal 30.

FIG. 1 shows only one side of a rotor vane 40 having a first channel 22 and a second channel 23 communicating with a high pressure chamber and a common channel 28 extending normal to a rotational axis of the rotor vane 40. One of skill in the art will appreciate that a second set of channels including another first channel 26, another second channel 27 and another common channel 29 (parenthetically labeled in FIG. 1, but not shown) can be provided at opposite ends of the rotor vane 40, e.g., on the left side of the vane shown in FIG. 1. A complete rotor vane showing first and second sets of channels 22, 23 and 26, 27, respectively is shown in FIGS. 2 and 4. The channels 22, 23 and 28 permit high pressure fluid to pressurize or energize the corner seal 30 against the end plate 60 to seal the corner region of the vane 40. Specifically, a first chamber and a second chamber may alternate between being high and low pressure chambers, respectively as the rotary actuator is energized and flows in a first and second direction.

The present inventors have determined that a shuttle valve of the related art can be positioned between the two chambers of alternating and relatively high and low pressures. The shuttle valve can be moved to allow the higher pressure to be routed to a third channel that feeds the area behind the corner seal 30. However, this would require the addition of a relatively expensive shuttle valve and the machining of multiple channels and precision machining of a bore in steel to receive and retain the shuttle valve.

Accordingly, in a preferred embodiment shown in FIG. 1, a single first channel 22 is utilized that is machined from the bottom of a vane seal groove 25 that extends to an area behind the corner seal 30. By the natural operation of the vane seal 20, the area under the seal 20 is always the higher pressure of the two adjacent chambers, e.g., a pair of channels 22, 23 and 26, 27 in the vane seal are shown in FIGS. 2 and 4 that extend to two adjacent chambers of the rotary vaned actuator. Accordingly, the vane seal 20 is pushed to the low pressure side of the vane seal groove 25 by the high pressure in the opposite chamber to a first sealing position shown in FIG. 1. This action of the vane seal 20 permits the high pressure to enter the area under the vane seal 20. The first channel 22 then routes the high pressure to the corner seal via a common channel 28 and the second channel 23. The first and second channels 22, 23 are shown as diverging away from each other and the common channel 28 with respect to each other in a preferred embodiment shown in FIGS. 1, 2 and 4. The common channels 28, 29 are provided in a separate flow sleeve 21 that may be a separate element integrally fitted with the rotary vane 40 or may be formed out of the same piece of material. However, the preferred flow sleeve 21 shown as a separate, integral piece is shown in FIG. 1 as this facilitates greater ease in machining the various channels 22, 23, 28.

The first channel 22 extends from an outside peripheral edge of the vane seal 20 at the vane seal groove 25 and extending toward said common channel 28. The second channel 23 is drilled or bored through a single wall at an angle extending away from the common channel 28 and the first channel 22, and toward a rear portion of said corner seal 30. The common channels 28, 29 extend circumferentially and radially around the interior of the rotor vane(s) 40 to provide a continuous passage in communication with the respective first and second channels.

When the rotary actuator reverses direction, the vane seal 20 moves to the opposite side of the groove to a second sealing position and again the higher pressure is ported under the vane seal 20. Thus, the vane seal acts as the aforementioned shuttle valve without the need for any additional components or precision steel machining. As seen in FIGS. 2 and 4, a rotor vane 40 having a first pair of high pressure select channels 22, 23 and a second pair of high pressure select channels 26, 27 in communication with a second common channel 29 (not shown in FIGS. 2 and 4) is provided that operatively engages corner, spring seals 30 along a pair of end surfaces of the vane seal 20 thereof.

The rotary actuator shown in FIG. 1 may include a single rotor vane 40 or more than one rotor vane. By the natural operation of the vane seal 20, the area under the seal 20 is always the higher pressure of the two adjacent chambers. Due to tolerances the vane seal 20 is pushed to the low pressure side of the groove 25 by the high pressure region of the opposite, high pressure chamber. The common channel 28 then routes the high pressure fluid from beneath the vane seal 20 to the corner seal 30. When the rotary actuator reverses direction, the vane seal 20 moves to the opposite side of the vane seal groove 25 and again the higher pressure is ported under the vane seal 20.

The vane seal 20 acts as a shuttle valve without the need for any additional components or precision machining. As seen in FIGS. 2 and FIG. 4, a second pair of first and second channels 26, 27 also extends from a lower portion of the vane seal groove 25 of the vane seal 20 to the common channel 28 beneath the vane seal 20, wherein the low pressure chamber is in fluid communication with the corner seal 30 via the second channel 27 and the second common channel 29. As seen in FIGS. 2 and FIG. 3, the second channel 23 extends in a direction opposed to and diverging away from the first single channel 22 to accommodate reversals of the actuator and automatic porting of the respective high pressure chamber to the corner seal 30. The two common channels 28, 29 are formed to be substantially normal to a longitudinal axis of the vane seal groove 25 and extend radially and circumferentially around a flow sleeve 21 of the rotor vane 40 that is shown in greater detail in FIG. 1. As seen in FIG. 1, the common channels 28, 29 may be further sealed with the use of O-rings or other sealing members.

What is claimed is:

1. A rotary actuator comprising;

an actuator housing;

a rotor having an axis of rotation mounted in the housing and including at least one rotor vane rotatable with the rotor, the rotor vane having a first edge parallel to the axis of rotation and a second edge extending from the first edge, the rotor including a vane opening in said first edge into a first vane channel in said at least one vane;

an endplate in the housing adjacent said rotor vane second edge;

a vane seal on said rotor vane first edge over the vane opening and engaging said actuator housing, said at least one rotor vane and said vane seal dividing said actuator housing into a first chamber and a second chamber;

a corner seal mounted in a corner seal recess in said endplate, said corner seal being shiftable between a first position contacting said rotor vane second edge to form a seal between said first chamber and said second chamber and a second position allowing fluid communication between said first chamber and said second chamber; and a second vane channel in fluid communication with said first vane channel and said corner seal recess;

said vane seal being mounted to expose said vane opening to pressure in said first chamber when the pressure in said first chamber is greater than the pressure in said second chamber and to expose said vane opening to the pressure in the second chamber when the pressure in the second chamber is greater than the pressure in the first chamber;

whereby, the higher pressure of the pressures in the first chamber and the second chamber is applied against the corner seal via the first vane channel, the second vane channel and the corner seal recess to maintain said corner seal in said first position.

2. The actuator of claim 1 including a third channel connecting said first channel and said second channel.

3. The actuator of claim 1 wherein said corner seal comprises a spring seal.

4. The actuator of claim 2 wherein said third channel is annular.

5. A rotary actuator comprising;

an actuator housing;

a rotor having an axis of rotation mounted in the housing and including at least one rotor vane rotatable with the rotor, the rotor vane having a first edge parallel to the axis of rotation and a second edge extending from the first edge, and including a vane opening in said first edge into a first vane channel in said at least one vane;

an endplate in the housing adjacent said rotor vane second edge;

a vane seal on said rotor vane first edge over the vane opening and engaging said actuator housing, said at least one rotor vane and said vane seal dividing said actuator housing into a first chamber and a second chamber;

a corner seal mounted in a corner seal recess in said endplate, said corner seal being shiftable between a first orientation contacting said rotor vane second edge to form a seal between said first chamber and said second chamber and a second orientation allowing fluid communication between said first chamber and said second chamber; and a second vane channel in fluid communication with said first vane channel and said corner seal recess;

said vane seal being shiftable between a first position exposing said vane opening to pressure in said first chamber when the pressure in said first chamber is greater than the pressure in said second chamber and a second position exposing said vane opening to the pressure in the second chamber when the pressure in the second chamber is greater than the pressure in the first chamber to maintain said corner seal in said first orientation.

6. The actuator of claim 5 including a third channel connecting said first channel and said second channel.

7. The actuator of claim 5 wherein said corner seal comprises a spring seal.

8. The actuator of claim 6 wherein said third channel is annular.

9. A method of sealing a corner region of a vane in a rotary vane actuator, the rotary vane actuator comprising:

an actuator housing;

a rotor having an axis of rotation mounted in the housing and including at least one rotor vane rotatable with the rotor, the rotor vane having a first edge parallel to the axis of rotation and a second edge extending from the first edge, and including a vane opening in said first edge into a first vane channel in said at least one vane;

an endplate in the housing adjacent said rotor vane second edge;

a vane seal on said rotor vane first edge over the vane opening and engaging said actuator housing, said at least one rotor vane and said vane seal dividing said actuator housing into a first chamber and a second chamber;

a corner seal mounted in a corner seal recess in said endplate, said corner seal being shiftable between a first orientation contacting said rotor vane second edge to form a seal between said first chamber and said second chamber and a second orientation allowing fluid communication between said first chamber and said second chamber; and a second vane channel in fluid communication with said first vane channel and said corner seal recess;

the method comprising the steps of:

exposing the vane opening to the pressure in the first chamber when the pressure in the first chamber is greater than the pressure in the second chamber; and exposing the vane opening to the pressure in the second chamber when the pressure in the second chamber is greater than the pressure in the first chamber whereby the higher of the pressures in the first and second chambers is applied against the corner seal.

10. The method of claim 9 wherein said step of exposing the vane opening to the pressure in the first chamber comprises the step of making the pressure in the first chamber greater than the pressure in the second chamber.

* * * * *